US008117791B2

(12) United States Patent
Baccarini

(10) Patent No.: US 8,117,791 B2
(45) Date of Patent: Feb. 21, 2012

(54) ABUTMENT MEMBER

(75) Inventor: Tony Baccarini, Chelmsford (GB)

(73) Assignees: Tony Baccarini (GB); Nigel Aulton (GB)

( * ) Notice: Subject to any disclaimer, the term of this patent is extended or adjusted under 35 U.S.C. 154(b) by 1204 days.

(21) Appl. No.: 11/519,371

(22) Filed: Sep. 11, 2006

(65) Prior Publication Data

US 2007/0245654 A1 Oct. 25, 2007

(30) Foreign Application Priority Data

Apr. 10, 2006 (GB) ..... 0607223.5

(51) Int. Cl.
*E04F 21/02* (2006.01)
*E04F 19/00* (2006.01)
*E04F 13/04* (2006.01)

(52) U.S. Cl. ..... 52/443; 52/254; 52/272; 52/344; 52/364; 52/371

(58) Field of Classification Search ..... 52/241, 52/254, 255, 272, 364, 371, 375, 443, 600, 52/608, 716.1
See application file for complete search history.

(56) References Cited

U.S. PATENT DOCUMENTS

| | | | | |
|---|---|---|---|---|
| 1,465,539 | A * | 8/1923 | Atterbury | 52/366 |
| 1,555,555 | A * | 9/1925 | Comerma | 428/124 |
| 1,875,576 | A | 9/1932 | Een | |
| 2,110,728 | A * | 3/1938 | Hoggatt | 144/368 |
| 2,129,497 | A | 9/1938 | Horn | |
| 2,234,043 | A * | 3/1941 | Dworetz | 52/216 |
| 2,261,054 | A * | 10/1941 | Dietrich | 52/371 |
| 2,301,187 | A * | 11/1942 | Balhatchet | 52/105 |
| 2,453,221 | A | 11/1948 | Haden | |
| 2,537,715 | A | 1/1951 | Stead | |
| 3,391,509 | A | 7/1968 | Fruman | |
| 3,396,504 | A * | 8/1968 | De Oliveira | 52/575 |
| 3,420,016 | A | 1/1969 | Findlay | |
| 3,465,488 | A * | 9/1969 | Miller | 52/481.1 |
| 3,654,734 | A | 4/1972 | Lehman | |
| 3,935,049 | A * | 1/1976 | Schmidt et al. | 156/216 |
| 3,973,371 | A | 8/1976 | Heller | |

(Continued)

FOREIGN PATENT DOCUMENTS

DE 4300130 A1 7/1994

(Continued)

OTHER PUBLICATIONS

"UK Search Report for Application No. 0619068.0", (Oct. 24, 2006).

(Continued)

*Primary Examiner* — Robert Canfield
(74) *Attorney, Agent, or Firm* — Schwegman, Lundberg & Woessner, P.A.

(57) ABSTRACT

An abutment is provided for use as a start or end post of a plasterboard partition wall or as a join between two such walls which run in different directions. The abutment comprises an elongate plaster moulding designed to run between the ceiling and the floor and having an abutment surface for abutment against the end of the partition wall. In a preferred embodiment, the abutment includes a tapered edge at the abutment surface to provide a space at the join in which a skim of plaster can be applied to provide a seamless join between the partition wall and the abutment.

41 Claims, 8 Drawing Sheets

U.S. PATENT DOCUMENTS

| | | | | | |
|---|---|---|---|---|---|
| D245,018 | S | | 7/1977 | Harris | |
| D251,804 | S | | 5/1979 | Balkany et al. | |
| 4,753,622 | A | * | 6/1988 | Nakama | 446/85 |
| 4,837,993 | A | | 6/1989 | Studenski | |
| 4,964,250 | A | | 10/1990 | Nelson | |
| 5,115,605 | A | * | 5/1992 | Butler | 52/105 |
| 5,475,960 | A | | 12/1995 | Lindal | |
| 5,501,050 | A | | 3/1996 | Ruel | |
| D372,546 | S | | 8/1996 | Pelosi et al. | |
| 5,544,463 | A | | 8/1996 | Bergin | |
| 5,755,066 | A | * | 5/1998 | Becker | 52/241 |
| 5,819,458 | A | * | 10/1998 | Hadden | 40/782 |
| 5,934,030 | A | | 8/1999 | McDonald | |
| 6,026,620 | A | | 2/2000 | Spude | |
| 6,119,432 | A | | 9/2000 | Niemann | |
| 6,176,053 | B1 | * | 1/2001 | St. Germain | 52/232 |
| 6,228,507 | B1 | * | 5/2001 | Hahn | 428/542.2 |
| 6,286,286 | B1 | | 9/2001 | Simonar | |
| 6,408,576 | B1 | * | 6/2002 | Roth | 52/85 |
| D467,007 | S | | 12/2002 | Daudet et al. | |
| 6,560,944 | B1 | | 5/2003 | Wilson | |
| 6,604,331 | B1 | | 8/2003 | Pallas et al. | |
| 6,990,778 | B2 | | 1/2006 | Passeno et al. | |
| 7,404,272 | B2 | | 7/2008 | Piché | |
| D581,545 | S | | 11/2008 | Dove | |
| D597,683 | S | | 8/2009 | Baccarini | |
| D622,415 | S | | 8/2010 | Baccarini | |
| D629,125 | S | | 12/2010 | Johnston | |
| D634,026 | S | | 3/2011 | Baccarini | |
| D643,938 | S | | 8/2011 | Baccarini | |
| 2003/0089058 | A1 | | 5/2003 | Kunz et al. | |
| 2004/0055245 | A1 | * | 3/2004 | Fitch | 52/716.8 |
| 2004/0168384 | A1 | | 9/2004 | Wesolowska | |
| 2005/0011159 | A1 | | 1/2005 | Standal et al. | |
| 2009/0038250 | A1 | * | 2/2009 | Frenkil | 52/447 |

FOREIGN PATENT DOCUMENTS

| | | | | |
|---|---|---|---|---|
| DE | 29809789 | | | 9/1998 |
| DE | 20104657 | U1 | | 7/2001 |
| DE | 10041362 | | | 3/2002 |
| DE | 10102882 | | | 7/2002 |
| FR | 2793269 | | | 4/2003 |
| GB | 830602 | | | 3/1960 |
| GB | 2209135 | A | * | 5/1989 |
| GB | 2437083 | A | * | 10/2007 |
| WO | WO-0233187 | | | 4/2002 |
| WO | WO-0243953 | A1 | | 6/2002 |
| WO | WO-03001007 | | | 1/2003 |
| WO | WO-03076732 | A1 | | 9/2003 |
| WO | 2007/116198 | A1 | * | 10/2007 |

OTHER PUBLICATIONS

"UK Search Report for Application No. 0619068.0", (May 26, 2006).

"Application No. PCT/GB2007/000492 International Search Report mailed Jun. 19, 2007", 5 pgs.

"Application No. PCT/GB2007/000492 Written Opinion mailed Jun. 19, 2007", 6 pgs.

"U.S. Appl. No. 29/276,951, Response filed Mar. 2, 2009 to Restriction Requirement mailed Jan. 30, 2009", 3 pgs.

"U.S. Appl. No. 29/276,951, Notice of Allowance mailed Mar. 24, 2009", 7 pgs.

"U.S. Appl. No. 12/335,688, Response Filed Oct. 9, 2009 to Restriction Requirement mailed Sep. 18, 2009", 3 pgs.

"U.S. Appl. No. 12/335,688, Restriction Requirement mailed Sep. 18, 2009", 5 pgs.

"U.S. Appl. No. 29/335,688, Notice of Allowance mailed Dec. 15, 2009", 6 Pgs.

"U.S. Appl. No. 29/335,688, Supplemental Notice of Allowability Mailed Jul. 20, 2010", 3 Pgs.

"U.S. Appl. No. 29/359,398, Notice of Allowance mailed Jun. 23, 2010", 7 pgs.

"U.S. Appl. No. 29/359,398, Supplemental Notice of Allowance mailed Apr. 15, 2011", 3 pgs.

"U.S. Appl. No. 29/378,131, Non Final Office Action mailed Mar. 16, 2011", 6 pgs.

"U.S. Appl. No. 29/378,131, Response filed Jul. 18, 2011 to Non Final Office Action mailed Mar. 16, 2011", 5 pgs.

"U.S. Appl. No. 29/378,137, Notice of Allowance mailed Apr. 11, 2011", 9 pgs.

* cited by examiner

ABUTMENT MEMBER

CLAIM OF PRIORITY

The present patent application claims the priority benefit of the filing date of United Kingdom Application (UK) No. 0607223.5 filed Apr. 10, 2006, the entire content of which is incorporated herein by reference.

The present invention relates to abutments for internal partition walls made from, for example, plasterboard and an internal stud framework.

Internal walls and partitions which do not have to be load bearing are conventionally constructed using plasterboards attached to a framework of vertical studs, which are usually made either of wood or of metal, and which normally include cross-bracings or noggins or the like for structural stability. At the end of a run of partition wall, an abutment detail is usually provided to join the partition wall with, for example, a glass partition. Alternatively, if the stud wall is to end in the middle of a room, then a radius or flat fair end post made from either timber or aluminium or rolled steel is fixed to the end of the partition wall. A covering section is then provided to hide the junction between the plasterboard and the abutment and mastic is used to hide erratic gaps between the plasterboard and the covering section. Similarly, where two runs of such partition wall meet, a metal beading is usually provided at the join to allow the two partition walls to be secured together. Normal tape and joint finish is then used to hide the join between the two walls.

The present invention aims to provide a new abutment detail for such partition walls and which can be used either as a joint or a start or end of run post.

According to one aspect, the present invention provides an abutment for use as a start or end post of a partition wall or as a join between such walls. The abutment comprises an elongate plaster moulding, typically for extension between the floor and ceiling, and having at least one abutment surface running along its length for abutment against an end of the partition wall.

In a preferred embodiment, the abutment has two parallel side walls which extend in planes that are substantially perpendicular to the abutment surface and which run parallel to the respective outer surfaces of the partition wall and two tapered sides which extend between the abutment surface and those side walls. The advantage of using such tapered sides is that they provide a space in the regions of the join between the abutment and the partition wall in which a plasterer can "skim" the join, in one operation without having to perform a surface treatment on the abutment.

The abutment preferably includes one or more fixing substrates positioned along its length and cast within the abutment for allowing the abutment to be fixed to the partition wall. The fixing substrate may be formed, for example, from a wood or metal lath. The abutment may be formed to provide a flat or a curved fair end. The abutment may also be used to provide a join between two partition walls or between a partition wall and an existing wall of the building. A recess may also be provided in the abutment for receiving the end of a glass partition.

Preferably, the abutment comprises one or more fixing substrates positioned along its length adjacent said abutment surface for allowing the plaster abutment to be fixed to said end of the partition wall. Preferably, said fixing substrates are made from wood or metal. Preferably, one or more of said fixing substrates comprises a lath which extends along at least a portion of the length of the abutment.

Preferably, the abutment comprises at least one tapered side which extends along at least part of the length of the abutment and which is located adjacent said abutment surface.

Preferably, said abutment comprises at least one side wall which extends in a plane that is substantially perpendicular to said abutment surface to run parallel with an outer surface of said partition wall and said at least one tapered side extends between said abutment surface and said at least one side wall.

Preferably, the abutment comprises a recessed groove in a side wall of the abutment, which extends along at least a major part of the length of the abutment for receiving a glass partition or the like.

Preferably, the abutment comprises a fair end extending along the length of the abutment opposite said abutment surface. Preferably, said fair end is flat along the length of the abutment, in which case preferably said fair end lies parallel with said abutment surface. Alternatively, preferably said fair end is curved along the length of the abutment.

Preferably, the abutment is formed to provide two abutment surfaces, one for abutment against the end of the partition wall and another for abutment against a window mullion. Alternatively, preferably the abutment is formed to provide two abutment surfaces, one for abutment against the end of the partition wall and another for abutment against a wall which runs at an angle to the partition wall.

Preferably, said second abutment surface is for abutment against a wall which runs substantially perpendicular to the partition wall.

Preferably, the abutment is formed from a moulding of plaster and fibrous material.

Preferably, the abutment comprises one or more embedded strengthening members which extend within and along the length of the abutment moulding to provide strength to the moulding.

Preferably, the abutment is adapted for abutment against the end of a plasterboard partition wall.

The present invention also provides an abutment that is adapted for use as a start or end post of a (preferably plasterboard) partition wall or as a join between two such walls, the abutment comprising an elongate body having at least one substantially planar abutment surface running along its length for abutment against an end of the partition wall and at least one tapered side which extends along the length of the body and which is located adjacent the abutment surface.

Preferably, said abutment comprises at least one side wall which extends in a plane that is substantially perpendicular to said abutment surface to run parallel with an outer surface of said plasterboard partition wall and said at least one tapered or recessed side extends between said abutment surface and said at least one side wall.

Preferably, said side wall defines a main body portion of the abutment and said abutment surface has a width perpendicular to the length of the abutment that is smaller than a width of said main body portion of said abutment.

Preferably the abutment is formed as a plaster moulding.

Preferably the abutment is formed from a moulding of plaster and fibrous material.

The present invention also provides a method of making an abutment for use as a start or end post of a (preferably plasterboard) partition wall or as a join between such walls, the method comprising: providing an elongate mould having one or more mould parts, which define a desired shape of the abutment; pouring a liquid plaster into the mould; allowing the plaster to harden; and removing the hardened plaster abutment from the mould. During or prior to the moulding process, strengthening material may be added in the cavity of the mould so that it becomes cast within the plaster abutment. In this way, additional strength can be provided to the plaster abutment.

Preferably, the method further comprises adding fibrous material to the plaster for strengthening the abutment.

Preferably, the method further comprises placing one or more fixing substrates into the mould before plaster is provided in the mould so that the or each fixing substrate is cast into the plaster abutment when hardened.

Preferably, the method further comprises placing one or more fixing substrates into the mould after the plaster has been provided in the mould, but before the plaster has hardened, so that the or each fixing substrate is cast into the plaster abutment when the plaster hardens.

Preferably, said placing step places said one or more fixing substrates adjacent a surface of the mould that will define an abutment surface of said abutment.

According to a further aspect of the present invention there is provided a method of making an abutment for use as a start or end post of a plasterboard partition wall or as a join between two such walls, the method comprising: providing an elongate mould having one or more mould parts; providing liquid plaster into the mould; and running a cutting member having a profile corresponding to the desired profile of the abutment member over the wet plaster to cut out an abutment of the desired profile.

These and other features and advantages of the invention will become apparent from the following detailed description of preferred embodiments, in which.

Figure 1:
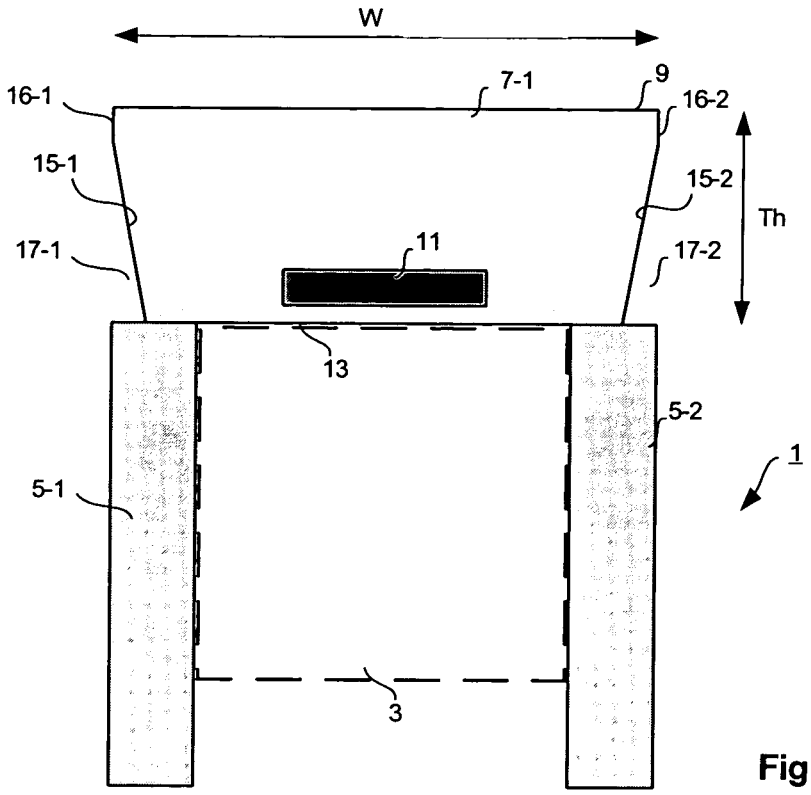
FIG. 1 is a cross-sectional view of a partition wall and showing a cross-section of an abutment for providing a flat fair end to the partition wall.
Figure 8:
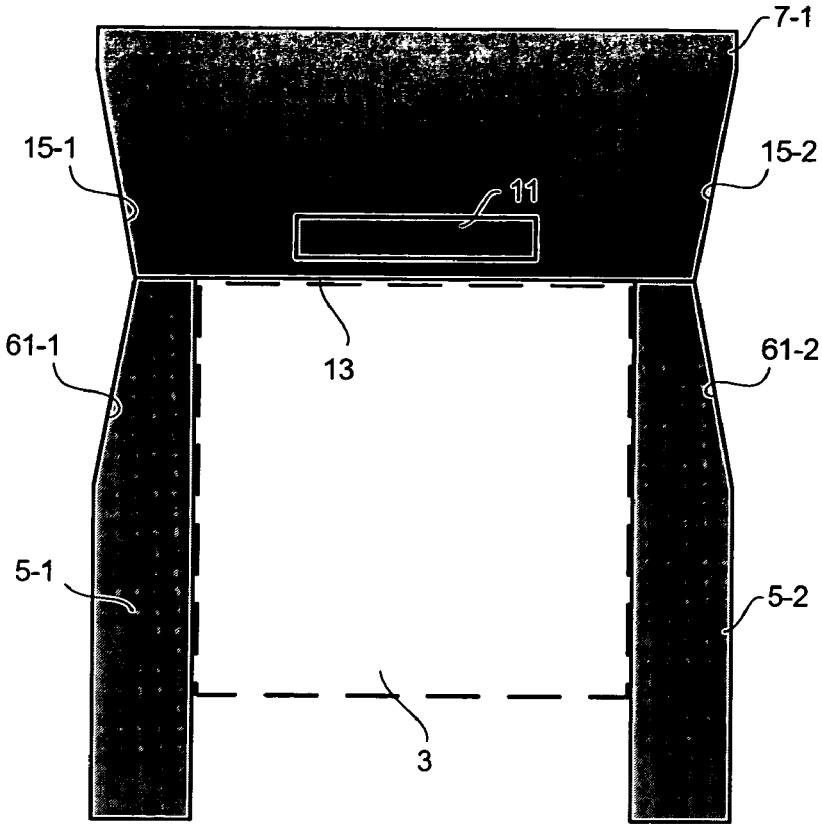
Figure 9:
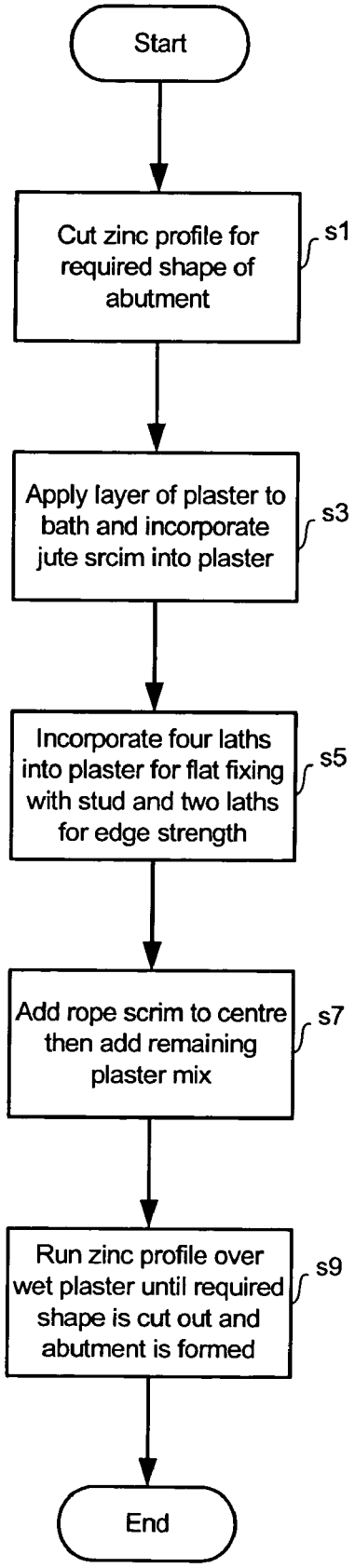
Figure 10:
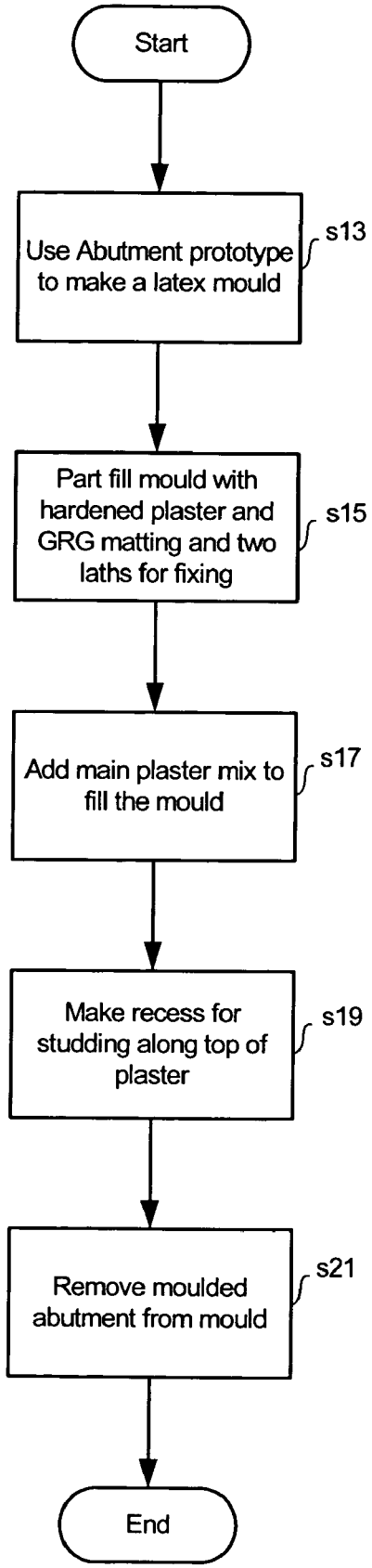

FIG. 8 schematically illustrates the abutment shown in FIG. 1 when used with plasterboards having a tapered end at the join with the abutment;

FIG. 9 is a flow chart illustrating one method that can be used to make the elongate plaster abutments illustrated in cross-section in FIGS. 1 to 8; and FIG. 10 is a flow chart illustrating another method that can be used to make the elongate plaster abutments illustrated in cross-section in FIGS. 1 to 8.

EMBODIMENTS

FIG. 1 is a cross-sectional view (in a horizontal plane) illustrating the end of a plasterboard partition wall 1. As is well known the partition wall 1 is defined by a central framework of vertical studs (which may be wood or metal), one of which is shown in FIG. 1 and referenced 3. The outer surfaces of the partition wall 1 are defined by two parallel runs of plasterboard 5-1 and 5-2, which are attached to the stud work 3 (usually by fixing screws, not shown). FIG. 1 also illustrates the cross-sectional view of an elongate abutment member 7-1 which typically runs vertically, from floor to ceiling. In this embodiment, the abutment member 7-1 provides a fair end 9 to the partition wall 1 and is preformed as a fibre and plaster moulding. Typically, the abutment member 7 will be moulded in lengths of 3 (or more) metres and then cut to size to fit between the ceiling and floor. As illustrated in FIG. 1, the abutment 7-1 also includes one or more wood laths 111 that extend along the length of the abutment member 7-1 adjacent the surface 13 which abuts against the end of the partition wall 1. The wood laths act as a fixing substrate, for allowing the abutment member 7-1 to be fixed to the stud 3 by appropriate fixing screws (not shown). The wood laths also provide strength to the abutment member 7-1.

FIG. 1 also shows that, in this embodiment, the abutment member 7-1 has tapered sides 15-1 and 15-2, which extend between the abutment surface 13 and two side walls 16-1 and 16-2. As illustrated in FIG. 1, the width (W) of the main part of the abutment member 7-1 is chosen so that the two side walls 16-1 and 6-2 lie in the same planes as the respective outer surfaces of the plasterboards 5-1 and 5-2. As a result of the tapering sides 15-1 and 15-2, spaces 17-1 and 17-2 are provided that facilitate the application of a skim of plaster in this join region to provide a "seamless" join between the abutment member 7-1 and the plasterboards 5-1 and 5-2. Further, as the abutment member 7-1 is formed from a plaster material, there is no need to pre-treat the abutment member 7 before applying the plaster skim.

In an alternative embodiment in addition to the application of a skim of plaster in the join region a skim of plaster is applied on the partition wall. Alternatively a wall covering, such as wallpaper, is applied to the partition wall and abutment depending on the desired finish.

As those skilled in the art will appreciate, partition walls 1 come in various different standard thicknesses depending on the width of the stud 3 and the plasterboards 5. Therefore, in this embodiment, abutment members 7-1 having different widths (W) are provided. Standard stud widths for use in the UK include 50 mm, 75 mm, 100 mm and 145 mm. For other countries similar standard widths would be provided depending on the standard widths of partition walls used in those countries. Further, the thickness (Th) of the abutment member 7-1 can also be varied depending on the application. In the embodiment illustrated in FIG. 1, the thickness is approximately 30 mm, with the tapered sides 15-1 and 15-2 starting 5 mm below the fair end surface 9. The angle of the taper can also vary, depending on the application. In this embodiment, the angle is chosen so that the abutment member 7-1 provides a recess of 3 mm at the abutment surface 13 on each side of the partition wall 1, but a figure of between 1.5 mm and 6 mm is practicable. Recesses of this size provide adequate space to allow the plaster skim to be applied and "keyed" into the join, but are not too large to cause the plaster skim to crack when dry.

In an alternative embodiment in which a plaster skim is applied to the partition wall as well as the recess the width of the abutment will be such that it will be the same thickness as the partition wall and the plaster skim combined. Alternatively, and depending on the application, the abutment will be the same width as the thickness of the partition wall without the plaster skim and as such the abutment will also receive a covering skim of plaster. In this alternative the thickness of the plaster skim may be tapered down to the abutment in the region of the recess.

When assembling the partition wall, the abutment member 7-1 may be prefixed to the stud 3 before the plasterboards 5-1 and 5-2 are attached. This offers the advantage that the abutment member 7-1 can be attached to the stud by inserting screws through the stud 3 into the wood lath 11. This is advantageous, because the fair surface 9 of the abutment member 7-1 does not have to be damaged by insertion of screws and then filled using an appropriate filler. Once the abutment member 7-1 is attached to the stud 3, the plasterboards 5-1 and 5-2 can then be fixed to the stud 3 in a conventional manner. The spaces 17-1 and 17-2 defined by the tapered sides 15-1 and 15-2 of the abutment member 7-1 can then be filled with an appropriate skim of plaster leaving a seamless join between the plasterboards 5-1 and 5-2 and the abutment member 7-1.

Alternatively, the abutment member 7-1 can be fixed to the end of the partition wall 1 after the plasterboards 5-1 and 5-2 have been secured to the stud 3. In this case, however, the abutment member 7-1 has to be secured to the stud 3 by drilling holes through the fair surface 9 of the abutment member 7-1 or has to be glued to the partition wall.

The abutment member 7-1 illustrated in FIG. 1 offers a number of advantages over the traditional techniques for providing similar fair end posts at the end of a partition wall. These advantages include:

(i) As the abutment member 7-1 is formed as a fibre and plaster moulding, accurate fabrication is possible. This means, for example, that the abutments can be made completely straight along its length which makes it easier for the builder to ensure that the partition wall is also vertical. Further, as the abutment is made of plaster, a skim of plaster can be directly applied to the surface of the abutment without pre-treatment.

(ii) As no metal angles or plasterboards need to be cut and taped and jointed to form the end post, the time taken to erect the partition wall is reduced, thereby making it cheaper to erect such partition walls.

Figure 2:
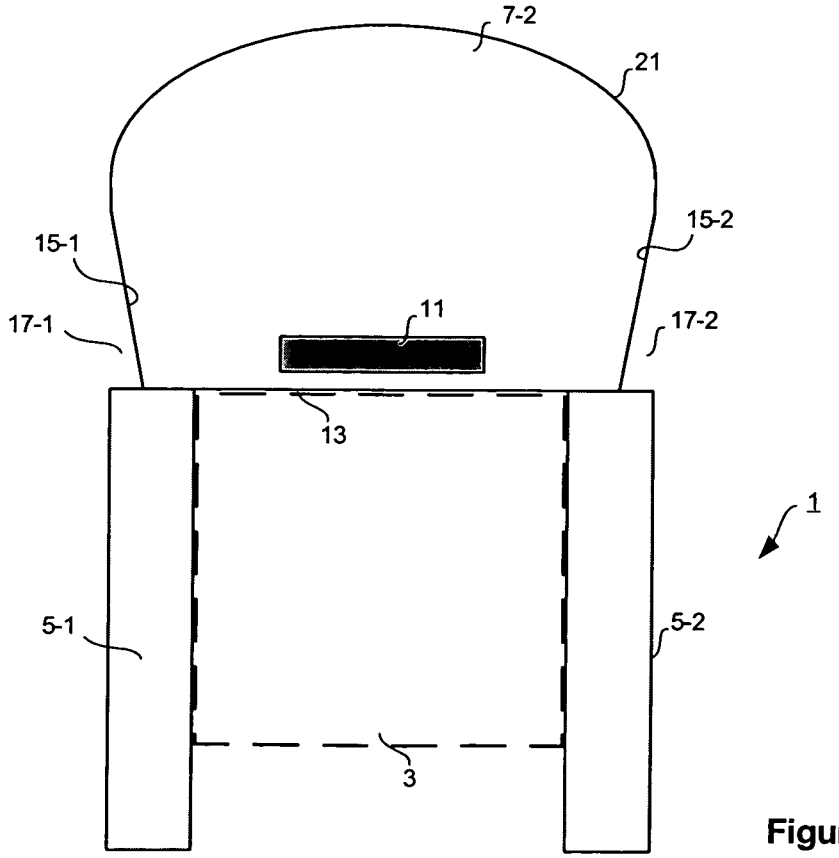
FIG. 2 is a cross-sectional view of a partition wall and showing a cross-section of an abutment for providing a radius end for the partition wall.

In the embodiment shown in FIG. 1, the abutment member 7-1 has a flat fair end 9. FIG. 2 illustrates an alternative cross-section of an elongate abutment member 7-2 which provides a radius or curved fair end 21. The remaining features of the abutment member 7-2 are the same as those of the abutment member 7-1 shown in FIG. 1 and will not be described again.

Figure 3:
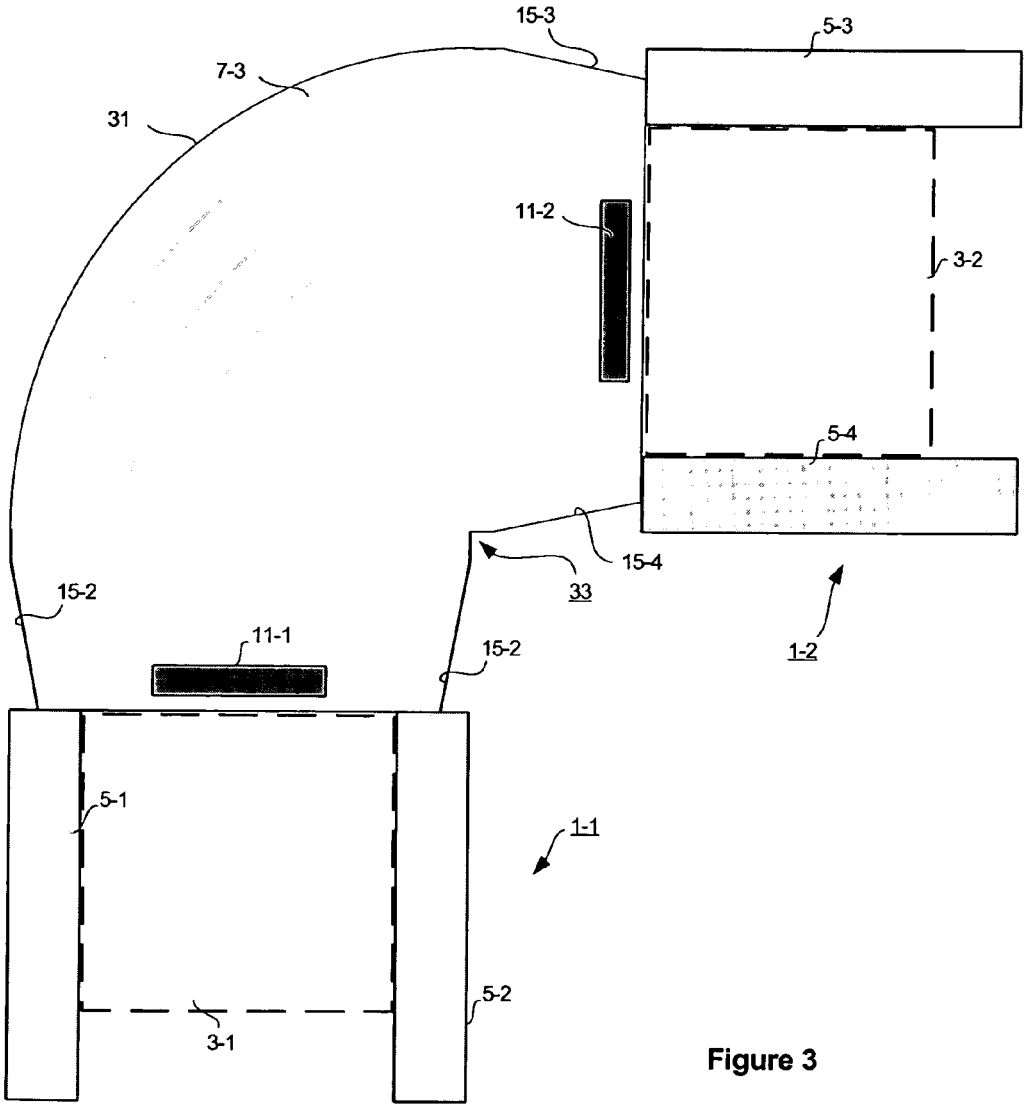
FIG. 3 is a cross-sectional view of two partition walls running at right-angles to each other and showing a cross-sectional view of an abutment joint which provides a right-angled join between the two partition walls on an inside surface and which provides a curved join on an outside surface.

In addition to providing end posts, the abutment member 7 may be used for joining two partition walls which run at angles to each other. FIG. 3 illustrates the cross-section of an elongate abutment member 7-3 which can be used for connecting two stud walls 1-1 and 1-2, which run perpendicular to each other. As illustrated in FIG. 3, the abutment member 7-3 in this embodiment includes four tapered sides 15-1, 15-2, 15-3 and 15-4 and is arranged to provide a curved outer surface 31 in the join between the two partition walls 1-1 and 1-2 and to provide a right-angled join 33 on the inside surface of the partition walls 1-1 an 1-2.

As those skilled in the art will appreciate, other types of abutment members 7 can be provided for connecting partition walls 1 which run at different angles (not necessary at right-angles). Further, the abutment member 7 may also be modified to provide a right-angled edge on the outer surface 31 as well as the right-angled edge 33 on the inner surface. Similarly, the inner surface 33 may also be curved to provide a curved inner join between the two partition walls 1-1 and 1-2.

Figure 4:
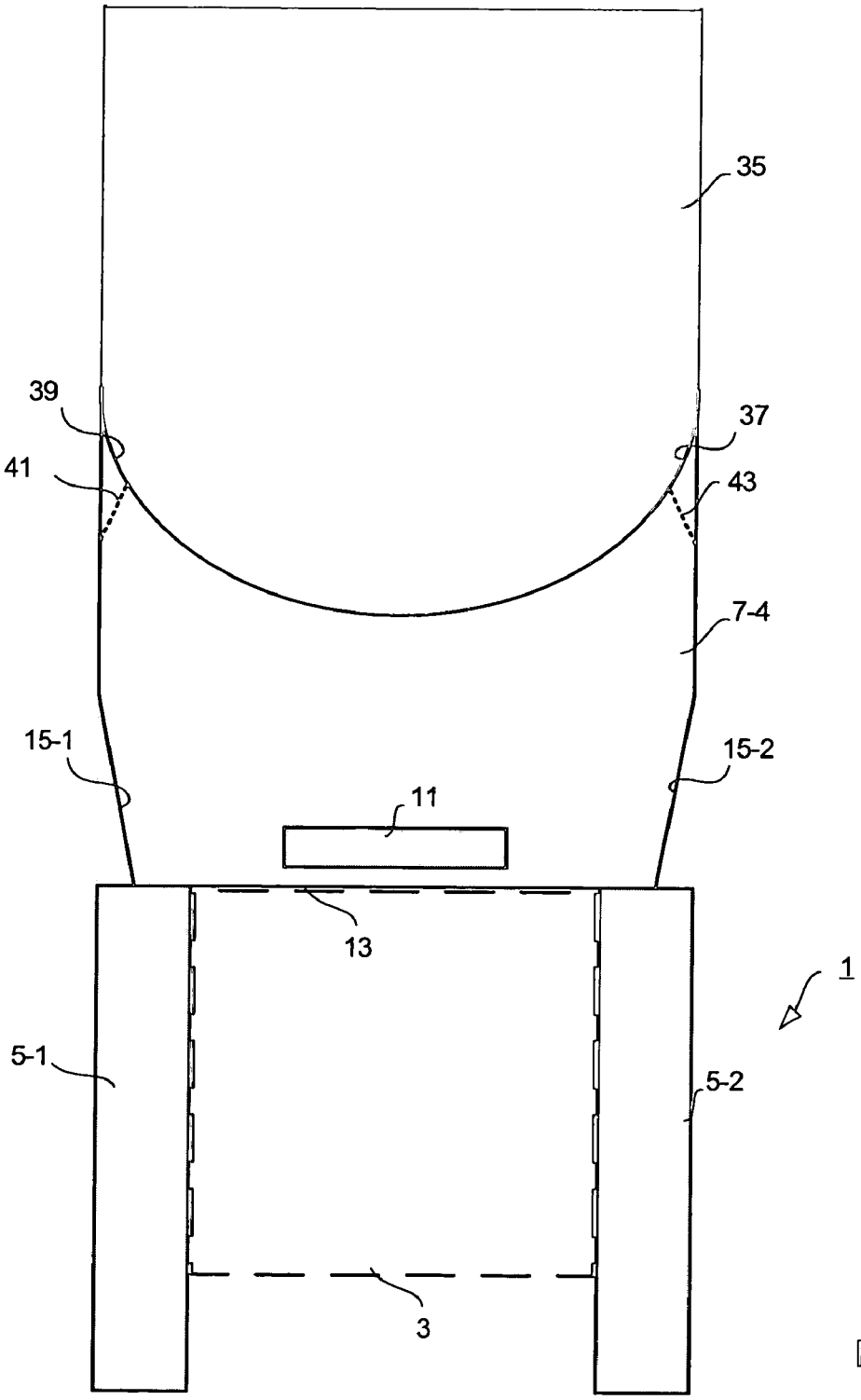
FIG. 4 is a cross-sectional view illustrating a cross-sectional view of an abutment for providing a join between a window mullion and a partition wall.

In addition to providing end posts for a partition wall 1 or for providing a join between two partition walls 1-1 and 1-2, the abutment member 7 can also be used as the join between the start of a partition wall and an existing design detail within the building. FIG. 4 illustrates an example of this. In particular, FIG. 4 illustrates the cross-section of a window mullion 35 having a radius (curved) end face 37. FIG. 4 also illustrates a cross-sectional view of a plaster moulded abutment member 7-4 that has been moulded to have a curved inner surface 39 matching the curved profile of the mullion 35. FIG. 4 also illustrates that the abutment member 7-4 abuts against the partition wall 1 in the same way as in the embodiment described with reference to FIG. 1. As illustrated by the dashed lines 41 and 43, tapered sides may also be provided at the join between the mullion 35 and the abutment member 7-4. As before, these tapered sides provide space to allow a skim of plaster to be provided in the region of the join between the mullion 35 and the abutment member 7-4 to make a seamless joint between the two.

Figure 5:
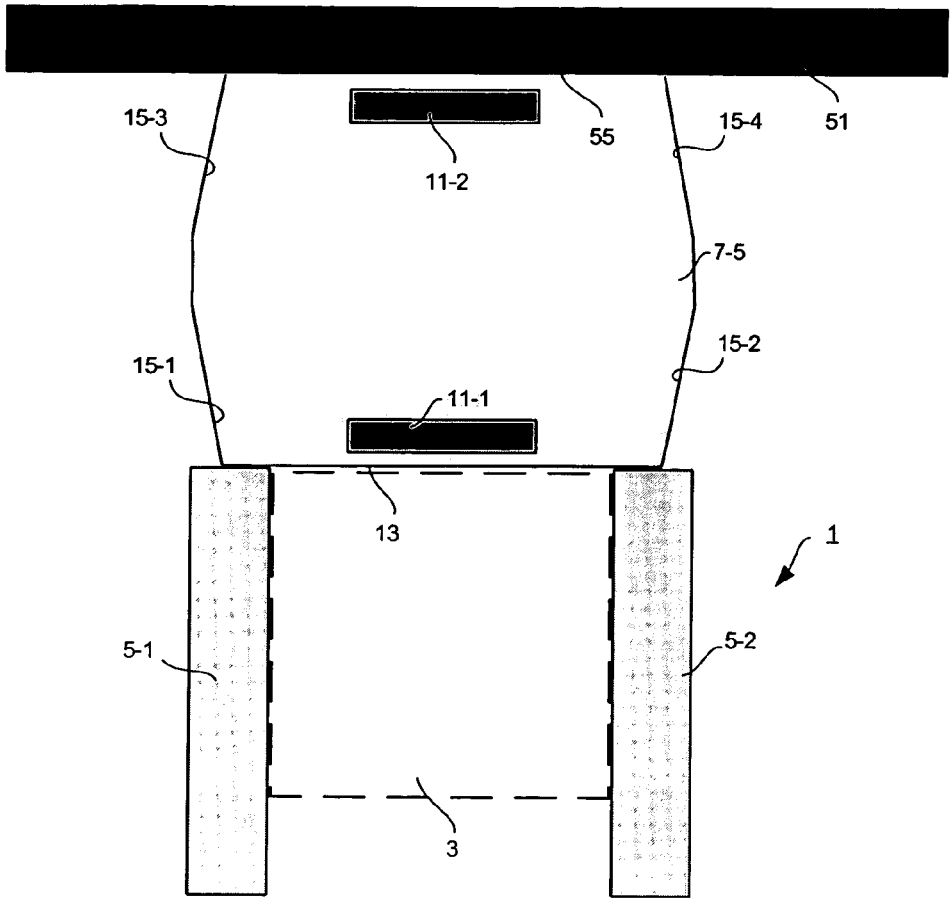
FIG. 5 is a cross-sectional view of an abutment that provides a join between a partition wall and another wall running at ninety degrees to the partition wall.

FIG. 5 is a cross-sectional view illustrating the form of another elongate abutment member 7-5 that can be used to define the start of a partition wall 1 from an existing wall 51 running perpendicular to the partition wall 1. Wall 51 may also be a partition wall or it may be a brick wall or the like. As shown in FIG. 5, the abutment member 7-5 includes the same two tapered sides 15-1 and 15-2 adjacent the join with the partition wall 1. The abutment member 7-5 also includes tapered sides 15-3 and 15-4 around the join with the wall 51. As before, the tapered sides 15-3 and 15-4 provide a space for a skim of plaster to be provided in the join area, thereby allowing a seamless join with the wall 51. As illustrated in FIG. 5, the abutment member 7-5 also includes a second wood lath 11-2 adjacent the second abutment surface 55, for allowing the abutment member 7-5 to be secured to the wall 51 using suitable fixing screws (not shown). Instead of or in addition to such fixing screws, cement or glue can be provided in the boundary between the wall 51 and the second abutment surface 55 for securing the abutment member 7 to the wall 51.

Figure 6:
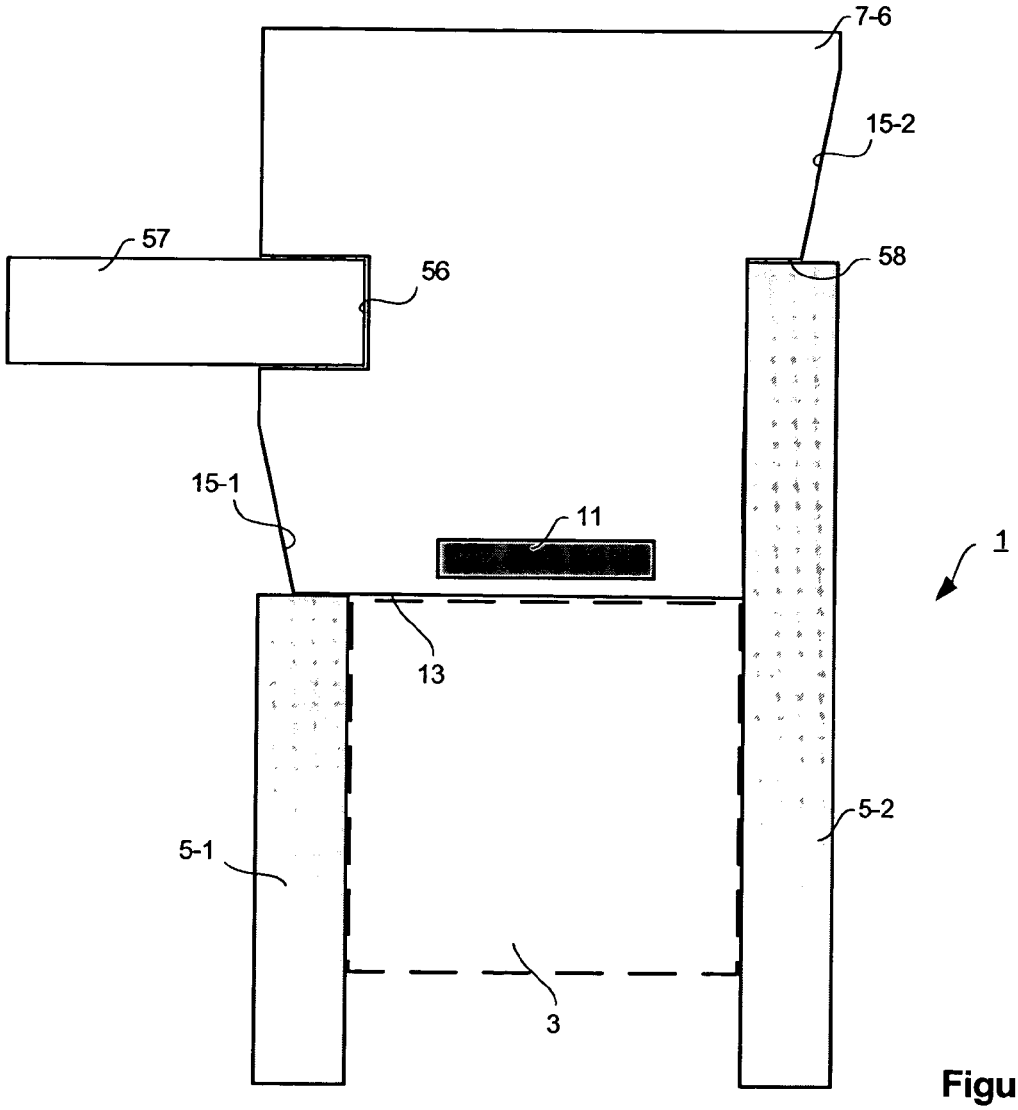
FIG. 6 is a cross-sectional view illustrating an abutment which can be used at the end of a partition wall to provide a join with a glass partition which runs at ninety degrees to the partition wall.

In addition to providing a join between two partition walls running in different directions, the moulded abutment 7 can also be used to provide a join between a run of partition wall 1 and a glass partition. The cross-section of an appropriate elongate abutment member 7-6 for this purpose is illustrated in FIG. 6. As shown, the abutment member 7-6 includes a U-shaped recess 56 into which the end of a glass partition 57 can fit. FIG. 6 also shows that the abutment member 7-6 includes a second abutment surface 58 which is for abutment against the right hand plasterboard 5-2. The remaining components of the abutments member 7-6 are the same as those shown in FIG. 1 and will be not, therefore, be described again.

Figure 7:
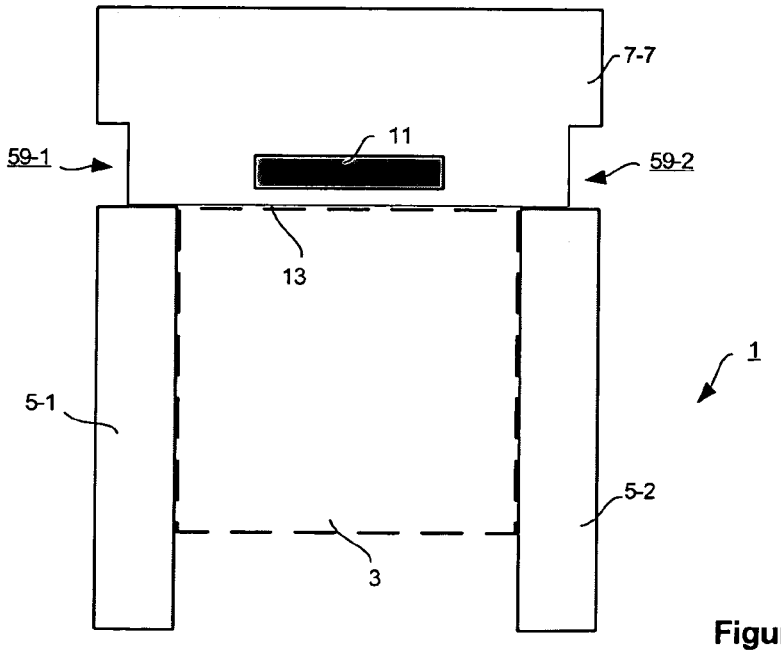
FIG. 7 is a cross-sectional view illustrating an alternative abutment which can be used to define a fair end for a partition wall.

In the above embodiments, the abutment member 7 was arranged to have one or more tapered sides 15 near the join with the plasterboard 5. As those skilled in the art will appreciate, it is not essential to have such tapered sides. Instead, an abutment member 7 may be provided with sides that are designed to lie flush with the outer surface of the plasterboard 5. In this case, tape or other filler could be used to cover the join between the abutment member 7 and the plasterboard 5. In a further alternative, as illustrated in FIG. 7, the abutment member 7-7 may be arranged to have stepped recesses 59-1 and 59-2 near the join with the plasterboards 5, to allow space for a skim of plaster to be applied to each recess to provide a seamless join between the abutment member 7-7 and the plasterboards 5.

In all of the embodiments described above, standard square edge plasterboard 5 has been used. In an alternative embodiment, as illustrated in FIG. 8, plasterboards 5 having a tapered edge 61-1 and 61-2 may also be used to provide larger areas around the joins between the abutment member 7-1 and the plasterboards 5 into which a skim of plaster can be made to provide a seamless join.

In the above embodiment, one or more wood laths were cast within and along the length of the elongate abutment members 7. The wood lath provided a fixing substrate for allowing the abutment member 7 to be fixed to the stud 3 of the partition wall 1 using fixing screws. As those skilled in the art will appreciate, other fixing substrates could be used to achieve this purpose. For example, one or more laths may be made out of metal (such as ferous metal or aluminium) or out of any other rigid product. In addition to providing a fixing substrate, the laths also act to strengthen the elongate abutment members 7. In addition to providing the laths, a separate metal, wood or rope core may be cast within the elongate abutment member 7 for providing further strength.

A number of different elongate plaster abutments 7 have been described above. These abutments 7 can be formed either by cutting wet plaster from an elongate rectangular block of plaster or by moulding the plaster using a suitable mould formed from one or more mould pieces. A description will now be given of the way in which a prototype abutment 7 was made by cutting plaster from an elongate block. A description will then be given as to how this prototype can be used to form a latex moulding which can then be used to make a number of similarly profiled abutment members 7.

FIG. 9 is a flow chart illustrating the steps performed to make a prototype abutment member 7. As shown, in step s1, a zinc profile for the required shape of abutment is cut. A smooth plaster mix is then made by mixing 20 litres of water with due proportion of herculite and kermicast. In step s3, a layer of this plaster mix is applied to an elongate rectangular bench mould and a 300 mm width by 3 m jute scrim is incorporated into this layer of plaster. In step s5, four laths are incorporated into the plaster for flat fixing with the stud 3 and two laths are incorporated into the plaster for providing strength to the edge of the abutment member 7. In step s7, a rope scrim is added to the centre of the plaster and the remaining plaster mix is added. Finally, in step s9, the zinc profile is run over the wet plaster until the required shape is cut out and the abutment member 7 is formed.

As those skilled in the art will appreciate, all of the abutment members 7 described upon may be manufactured using this technique. However, for ease and efficiency of manufacture, the abutment members 7 are preferably formed from a suitably shaped mould. FIG. 10 is a flow chart illustrating the main steps for a production process for making the above described abutment members. As shown, in step s13, the prototype abutment member made in the manner described above is used to make a latex mould. This involves placing the prototype abutment member 7 within an open top watertight container which is wider than and as deep as the prototype abutment. Latex rubber is then poured over the model and is prevented from leaking by the container. Once the rubber has set, it is peeled off the prototype abutment and is ready for use as the mould for production.

In step s15, the thus formed latex mould is part filled with a base of plaster with GRG matting (200 mm wide by 3 m long) inserted into the plaster together with 2 laths for fixing. GRG matting is formed from fibres similar to those used to make fibre glass boats. Then, in step s17, after the base of plaster has hardened the main plaster mix is added to fill the latex mould. In step s19, once all plaster and reinforcements have been incorporated into the mould, a recess is made along the length of the top of the plaster mould for studding purposes. Finally, once the plaster has hardened, the moulded abutment member 7 is removed from the mould. The mould can then be used again to make another abutment member 7 of the same profile.

It will be understood that the present invention has been described above purely by way of example, and modifications of details can be made within the scope of the invention.

The invention claimed is:

1. An abutment adapted for use as a start or end post of a partition wall or as a join between two such walls, the abutment comprising:

an elongate plaster body having at least one abutment surface running along its length for abutment against an end of the partition wall; and at least one formation adjacent the abutment surface which extends along at least part of the length of the abutment for receiving a skim of plaster, so as to provide a seamless join between the abutment member and the partition wall upon receipt of the plaster skim, the at least one formation being a tapered side of the abutment, wherein said abutment comprises at least one side wall which extends in a plane that is substantially perpendicular to said abutment surface to run parallel with an outer surface of said partition wall and wherein said at least one formation extends between said abutment surface and said at least one side wall.

2. An abutment according to claim 1, comprising at least one fixing substrate positioned along its length adjacent said abutment surface for allowing the plaster abutment to be fixed to said end of the partition wall.

3. An abutment according to claim 2, wherein said at least one fixing substrate is made from one of wood and metal.

4. An abutment according to claim 2, wherein said at least one fixing substrate comprises a lath which extends along at least a portion of the length of the abutment.

5. An abutment according to claim 1, wherein said at least one formation is a recessed portion of the abutment.

6. An abutment according to claim 1, comprising a recessed groove in a side wall of the abutment, which extends along at least a major part of the length of the abutment for receiving a glass partition or the like.

7. An abutment according to claim 1, comprising a fair end extending along the length of the abutment opposite said abutment surface.

8. An abutment according to claim 7, wherein said fair end is flat along the length of the abutment.

9. An abutment according to claim 7, wherein said fair end lies parallel with said abutment surface.

10. An abutment according to claim 7, wherein said fair end is curved along the length of the abutment.

11. An abutment according to claim 1, formed to provide two abutment surfaces, one for abutment against the end of the partition wall and another for abutment against a window mullion.

12. An abutment according to claim 1, formed to provide two abutment surfaces, one for abutment against the end of the partition wall and another for abutment against a wall which runs at an angle to the partition wall.

13. An abutment according to claim 12, wherein said second abutment surface is for abutment against a wall which runs substantially perpendicular to the partition wall.

14. An abutment according to claim 1, formed from a moulding of plaster and fibrous material.

15. An abutment according to claim 1, comprising at least one embedded strengthening members which extend within and along the length of the abutment moulding to provide strength to the moulding.

16. An abutment according to claim 1, adapted for abutment against the end of a plasterboard partition wall.

17. An abutment according to claim 16, wherein said formation is one of a tapered and recessed side which extends along the length of the body and which is located adjacent said abutment surface.

18. An abutment according to claim 17, wherein said abutment comprises at least one side wall which extends in a plane that is substantially perpendicular to said abutment surface to run parallel with an outer surface of said plasterboard partition wall and wherein said one of said tapered and recessed side extends between said abutment surface and said at least one side wall.

19. An abutment according to claim 18, wherein said side wall defines a main body portion of the abutment and wherein said abutment surface has a width perpendicular to the length of the abutment that is smaller than a width of said main body portion of said abutment.

20. An abutment according to claim 17, formed as a plaster moulding.

21. An abutment according to claim 17, formed from a moulding of plaster and fibrous material.

22. An abutment adapted for use as a start or end post of a partition wall or as a join between two such walls, the abutment comprising:

an elongate plaster body having at least one abutment surface running along its length for abutment against an end of the partition wall;

at least one fixing substrate positioned along a length of said abutment adjacent to said abutment surface for allowing the plaster abutment to be fixed to said end of the partition wall, the at least one fixing substrate being made from at least one of wood and metal; and at least one formation adjacent the abutment surface which extends along at least part of the length of the abutment for receiving a skim of plaster, so as to provide a seamless join between the abutment member and the partition wall upon receipt of the plaster skim, wherein said abutment comprises at least one side wall which extends in a plane that is substantially perpendicular to said abutment surface to run parallel with an outer surface of said partition wall and wherein said at least one formation extends between said abutment surface and said at least one side wall.

23. An abutment according to claim 22, wherein said at least one fixing substrate comprises a lath which extends along at least a portion of the length of the abutment.

24. An abutment according to claim 22, wherein said at least one fixing substrate is substantially parallel to the end of the partition wall.

25. An abutment according to claim 22, wherein said at least one fixing substrate runs substantially the whole length of the abutment.

26. An abutment according to claim 22, further comprising at least one strengthening core.

27. An abutment according to claim 26, wherein said at least one strengthening core is made from wood, metal or rope.

28. A combination comprising an abutment according to claim 1 and a partition wall, the abutment abutting the partition wall.

29. A combination according to claim 28, wherein said at least one formation receives a skim of plaster.

30. A combination according to claim 28, wherein a skim of plaster is received only in said at least one formation, so as to provide a seamless join between said partition wall and abutment.

31. A combination according to claim 28, wherein said formation extends between said abutment surface and a side of the abutment that is substantially perpendicular to said abutment surface, and said partition wall and said formation receive a skim of plaster up to the end of said formation, so as to provide a seamless join between said partition wall and abutment.

32. A combination according to claim 28, wherein said formation for receiving plaster is one of a tapered and recessed side which extends along the length of the abutment body and which is located adjacent said abutment surface.

33. An abutment adapted for use as a start or end post of a partition wall or as a join between two such walls, the abutment comprising:

an elongate plaster body having at least one abutment surface running along its length for abutment against an end of the partition wall, the abutment being adapted to abut against the end of the partition wall wherein the partition wall is comprised of plasterboard, said abutment comprising at least one side wall which extends in a plane that is substantially perpendicular to said abutment surface to run parallel with an outer surface of said plasterboard partition wall and wherein said one of said tapered and recessed side extends between said abutment surface and said at least one side wall; and at least one formation adjacent the abutment surface which extends along at least part of the length of the abutment for receiving a skim of plaster, so as to provide a seamless join between the abutment member and the partition wall upon receipt of the plaster skim, the at least one formation being a tapered side of the abutment, said formation is one of a tapered and recessed side which extends along the length of the body and which is located adjacent said abutment surface.

34. The abutment according to claim 33, comprising at least one fixing substrate positioned along its length adjacent said abutment surface for allowing the plaster abutment to be fixed to said end of the partition wall.

35. The abutment according to claim 34, wherein said at least one fixing substrate is made from one of wood and metal.

36. The abutment according to claim 34, wherein said at least one fixing substrate comprises a lath which extends along at least a portion of the length of the abutment.

37. An abutment adapted for use as a start or end post of a partition wall or as a join between two such walls, the abutment comprising:

an elongate plaster body having at least one abutment surface running along its length for abutment against an end of the partition wall, the abutment to abut the partition wall; and at least one formation adjacent the abutment surface which extends along at least part of the length of the abutment for receiving a skim of plaster, so as to provide a seamless join between the abutment member and the partition wall upon receipt of the plaster skim, the at least one formation being a tapered side of the abutment, said formation to extend between said abutment surface and a side of the abutment that is substantially perpendicular to said abutment surface, said partition wall and said formation to receive a skim of plaster up to the end of said formation, so as to provide a seamless join between said partition wall and abutment.

38. The abutment according to claim 37, comprising at least one fixing substrate positioned along its length adjacent said abutment surface for allowing the plaster abutment to be fixed to said end of the partition wall.

39. The abutment according to claim 38, wherein said at least one fixing substrate is made from one of wood and metal.

40. The abutment according to claim 38, wherein said at least one fixing substrate comprises a lath which extends along at least a portion of the length of the abutment.

41. The abutment according to claim 37, wherein said at least one formation is a tapered side of the abutment.

* * * * *

UNITED STATES PATENT AND TRADEMARK OFFICE

CERTIFICATE OF CORRECTION

PATENT NO. : 8,117,791 B2
APPLICATION NO. : 11/519371
DATED : February 21, 2012
INVENTOR(S) : Tony Baccarini It is certified that error appears in the above-identified patent and that said Letters Patent is hereby corrected as shown below:

On the cover page, item (73), in "Assignees", in column 1, lines 1-2, after "Nigel Aulton (GB)" insert -- Trading as Seamless Abutment Solutions (GB) --.

Signed and Sealed this
Fourteenth Day of August, 2012

David J. Kappos

David J. Kappos
*Director of the United States Patent and Trademark Office*